US006666357B2

(12) United States Patent
Bougamont et al.

(10) Patent No.: US 6,666,357 B2
(45) Date of Patent: Dec. 23, 2003

(54) DYNAMIC AIR REPLENISHING DEVICE FOR LIQUID PRODUCT DISPENSER

(75) Inventors: Jean-Louis Bougamont, Eu (FR); Bernard Clerget, Haudivilliers (FR); Pierre Dumont, Eu (FR)

(73) Assignee: Rexam-Dispensing Systems, Le Treport (FR)

( * ) Notice: Subject to any disclaimer, the term of this patent is extended or adjusted under 35 U.S.C. 154(b) by 0 days.

(21) Appl. No.: 10/297,612

(22) PCT Filed: Jun. 14, 2001

(86) PCT No.: PCT/FR01/01847

§ 371 (c)(1),
(2), (4) Date: Dec. 16, 2002

(87) PCT Pub. No.: WO01/96031

PCT Pub. Date: Dec. 20, 2001

(65) Prior Publication Data

US 2003/0150881 A1 Aug. 14, 2003

(30) Foreign Application Priority Data

Jun. 16, 2000 (FR) ..... 00 07683

(51) Int. Cl.[7] ..... B67D 5/42
(52) U.S. Cl. ..... 222/321.9; 222/385
(58) Field of Search ..... 222/321.1, 321.7, 222/321.9, 383.1, 385

(56) References Cited

U.S. PATENT DOCUMENTS

| | | | | | |
|---|---|---|---|---|---|
| 3,282,472 | A | * | 11/1966 | Roder | 222/321.9 |
| 3,596,808 | A | * | 8/1971 | Corsette | 222/321.9 |
| 3,685,739 | A | * | 8/1972 | Vainer | 222/383.1 |
| 3,762,647 | A | * | 10/1973 | Tada | 239/321 |
| 3,963,150 | A | * | 6/1976 | Steiman et al. | 222/211 |
| 4,057,176 | A | * | 11/1977 | Horvath | 222/321.9 |
| 4,272,228 | A | * | 6/1981 | Kutik et al. | 222/321.7 |
| 4,345,718 | A | * | 8/1982 | Horvath | 222/207 |
| 5,918,778 | A | * | 7/1999 | Schultz | 222/321.7 |
| 5,927,559 | A | * | 7/1999 | Bommer et al. | 222/321.9 |

FOREIGN PATENT DOCUMENTS

GB 966 13 7 A * 8/1964

* cited by examiner

*Primary Examiner*—Kenneth Bomberg
(74) *Attorney, Agent, or Firm*—Bacon & Thomas, PLLC

(57) ABSTRACT

The invention relates to an air-intake device for drawing air into a liquid dispenser equipped with a rigid reservoir (R) and with an atmospheric pump (P) provided, in particular, with a cylindrical and conical body (C) and with a support flange (S) fixed to the neck of the reservoir (R) while bearing against a sealing gasket surrounding the pump body, said device being characterized in that it comprises a flat annular gasket-forming washer (1) whose free edge (10) is in leaktight abutment towards the outside under a frustoconical shoulder (20) carried by a collar (2) engaged over said pump body, and is capable of being deformed elastically under the effect of internal suction to enable air to be drawn in.

4 Claims, 2 Drawing Sheets

DYNAMIC AIR REPLENISHING DEVICE FOR LIQUID PRODUCT DISPENSER

The present invention relates to an air-intake device for drawing air into a liquid dispenser.

A liquid dispenser is generally equipped with a rigid reservoir and with an atmospheric pump provided, in particular, with a cylindrical and conical body and with a support flange co-operating, as applicable, with an assembly ring or with an assembly cap crimped to the neck of the reservoir, while bearing against a sealing gasket surrounding the pump body.

A metered quantity or "dose" of liquid being dispensed generates suction in the fixed-capacity reservoir, and it is necessary to compensate for said suction by drawing in a corresponding volume of air. To this end, the pump body is provided with vent orifices suitable for putting the internal volume of the reservoir into communication with the outside during the final stage of dispensing.

Another technique for re-establishing the pressure balance necessary for the dispenser to operate properly consists in providing clearance between the fixing flange and/or the pump body and the neck of the reservoir and/or the assembly cap so as to enable air to be sucked in.

However, in all known techniques, the vent-forming means also enable liquid to leak out, especially when the level of liquid is above the vent, either by construction or by the dispenser being used specifically in the upside down position.

An object of the present invention is to solve those technical problems satisfactorily without modifying the conventional structure of dispensers.

The invention achieves this object by means of an air-intake device characterized in that it comprises a flat annular gasket-forming washer whose free edge is in leak-tight abutment towards the outside under a frustoconical shoulder carried by a collar engaged over said pump body, and is capable of being deformed elastically under the effect of internal suction to enable air to be drawn in.

In a specific embodiment, said frustoconical shoulder is formed directly on the outside side wall of the body of the pump.

In another embodiment, said frustoconical shoulder is carried by a collar engaged over said pump body.

According to an advantageous characteristic, said washer is provided with at least one radial slot extending from the free edge to facilitate deforming said free edge.

According to another characteristic, when the pump is in the closed position, the inside edge of said washer is deflected inwards under stress while having a portion of its outside face in contact with said shoulder.

In a variant, the inside face of said washer is provided with a peripheral keying groove serving to receive a rib provided on the top periphery of the reservoir.

The device of the invention makes it possible for sufficient air to be drawn in, while also guaranteeing that the dispenser is airtight.

The flexibility and elasticity of the annular gasket may be adjusted as a function of the level of suction generated in the reservoir due to liquid being dispensed.

The device of the invention is applicable to precompression pumps with or without vent orifices, without it being necessary to modify their structure.

The invention will be better understood on reading the following description with reference to the accompanying drawings, in which.

The device of the invention is designed to be used in a liquid dispenser for the purpose of acting after each occasion on which liquid is dispensed to enable air to be drawn into a rigid reservoir R (shown in part in the figures) containing the liquid.

This dispenser is equipped with an atmospheric pump P provided, in particular, with a cylindrical and conical body C underlying a support flange S fixed to the neck of the reservoir R while bearing against a sealing gasket surrounding the body C.

The dispenser shown further includes a pusher knob K carried by a spray head T mounted on the spray tube of the pump P, and a metal assembly ring D crimped both onto the flange S of the pump and onto the neck of the reservoir R, thereby holding the sealing gasket captive.

The device of the invention comprises a flat annular gasket-forming washer 1 provided with a free edge 10 suitable for being deformed elastically under the effect of internal suction so as to enable air to be taken into the reservoir R. The inside face of the washer 1 is provided with a keying groove 12 designed to receive a rib N having a complementary shape and provided on the top periphery of the reservoir R.

Figure 1B:
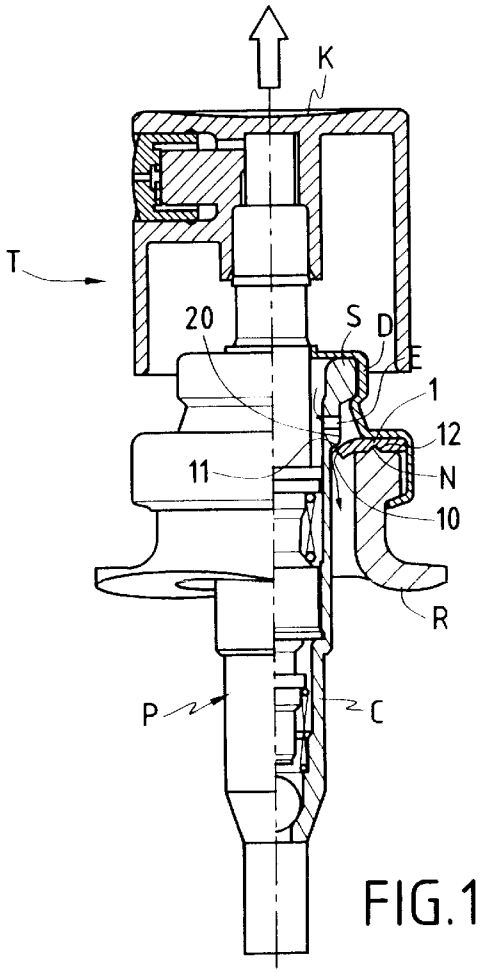
FIG. 1B is a view in section of an embodiment of the FIG. 1A device during the air-intake stage.
Figure 1A:
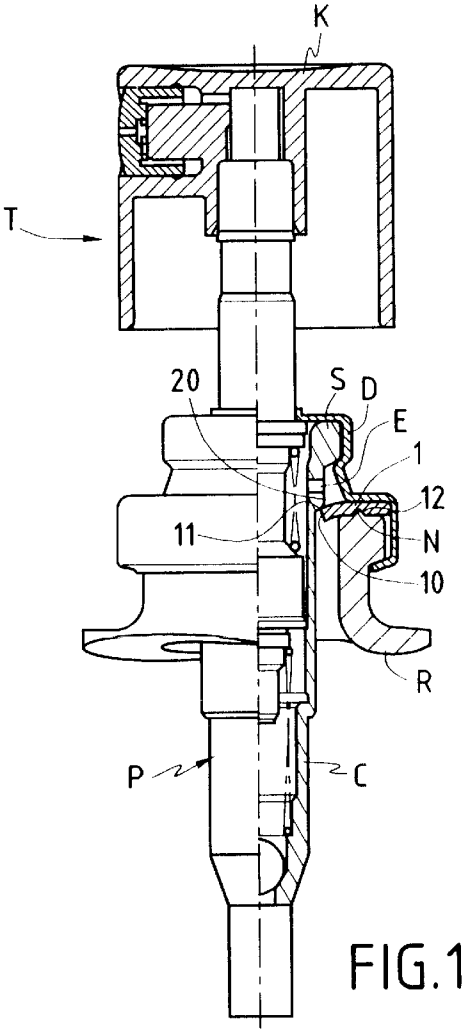
FIG. 1A is a view in section of an embodiment of the invention in the rest position.

In the embodiment of FIGS. 1A and 1B, the frustoconical shoulder 20 is formed directly by being integrally molded with the outside side wall of the body C of the pump P.

In this embodiment, the pump P is provided with a vent orifice E passing through the wall of the body C above the shoulder 20 and opening out above the washer 1 inside the ring D.

As shown in FIG. 1A, when the pump P is at rest in the closed position, the free edge 10 of the washer 1 is in leaktight abutment towards the outside, i.e. upwards in this example, under the frustoconical shoulder 2.

In this position, the free edge 10 is deflected inwards, i.e. downwards in this example, under stress, while having a portion of its outside face 11 in contact with the shoulder 20.

After a dose of liquid has been dispensed, the pusher knob K rises with the spray tube of the pump P, thereby generating suction inside the reservoir R.

This suction causes the free edge 10 of the washer 1 to be deformed elastically towards the inside of the reservoir R.

On coming out of abutment with the shoulder 20, the free edge 10 of the washer 1 opens a passageway allowing a compensating volume of air to be sucked in from the outside atmosphere via the inside of the pump body and via the vent orifice E, as shown by the arrows in FIG. 1B.

Figure 2B:
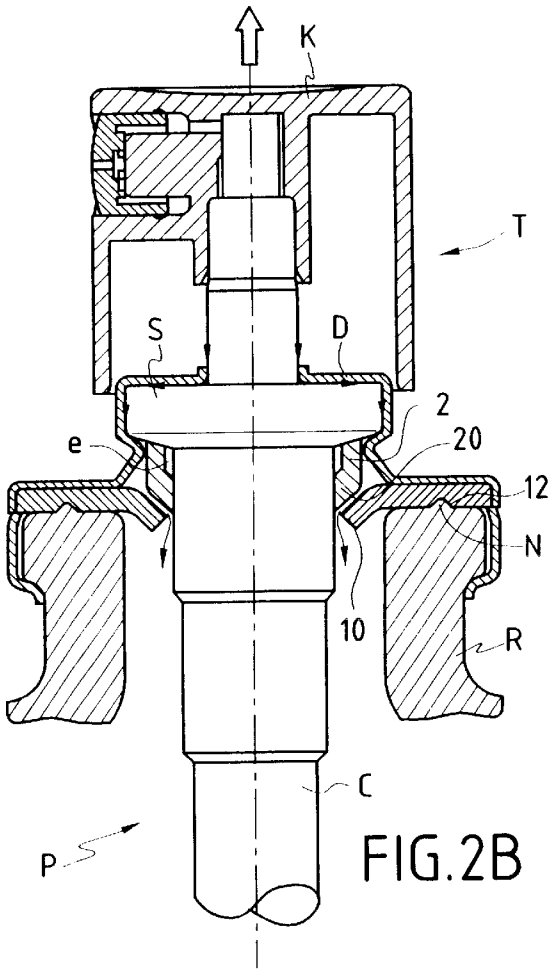
FIG. 2B is a view in section of the device shown in FIG. 2A during the air-intake stage.
Figure 2A:
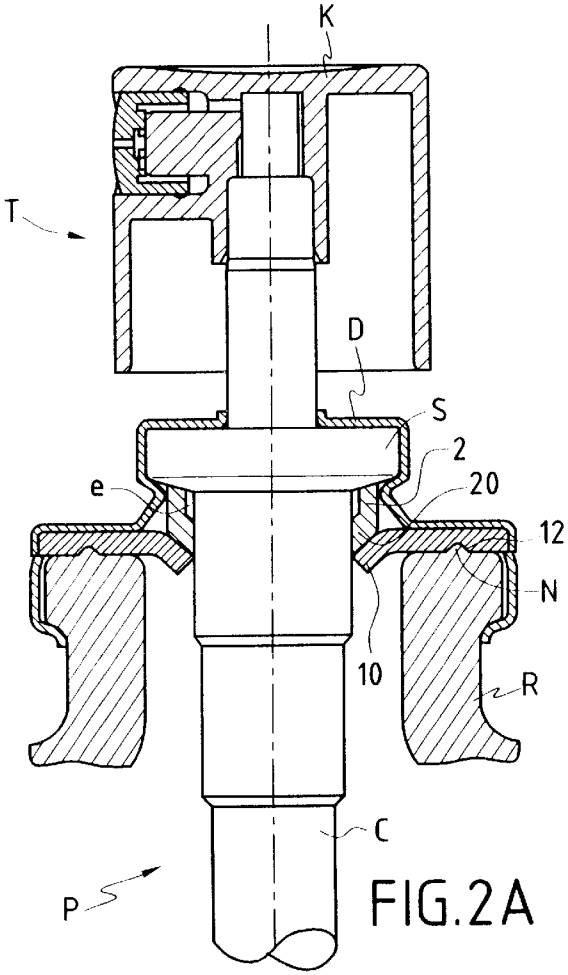
FIG. 2A is a view in section of another embodiment of the device of the invention in the rest position.

In the embodiment shown in FIGS. 2A and 2B, the pump P has no vent orifice. In which case, the frustoconical shoulder 20 is carried by a collar 2 engaged over the body C of the pump.

Preferably, the collar 2 comes into abutment upwards against the flange S.

In the variant shown, the bottom portion of the collar 2 that carries the shoulder 20 is in leaktight radial clamping engagement with the outside side wall of the body C, while the cylindrical top portion co-operates with the body C to define a gap.

As shown in FIG. 2B, while the pusher knob K is rising, air is drawn in via the outside of the pump body, between the ring D and the flange S, and then via the passageway opened under the shoulder 20 by the free edge 10 of the washer 1 deforming.

Figure 3:
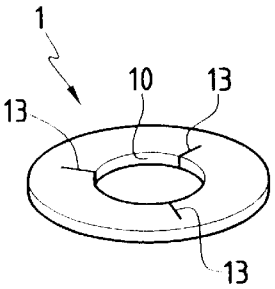
FIG. 3 is a view in perspective of the flat annular gasket used in the invention.

FIG. 3 shows an embodiment of the flat annular washer 1 used in the device of the invention.

To improve its flexibility, the washer 1 is provided with at least one slot, and with three such slots 13 in this example, which slots extend radially from the free edge 10 and facilitate elastic deformation thereof.

The length of the slots lies in the range one third of the width of the washer 1 to one half of the width of said washer.

What is claimed is:

1. An air-intake device for drawing air into a liquid dispenser equipped with a rigid reservoir (R) and with an atmospheric pump (P) provided with a cylindrical and conical pump body (C) and with a support flange (S) fixed to the neck of the reservoir (R) while bearing against a sealing gasket surrounding the pump body, said device further comprising a flat annular gasket-forming washer (1) having a free edge (10) that is in leaktight abutment towards the outside under a frustoconical shoulder (20) carried by a collar (2) engaged over said pump body, and is capable of being deformed elastically under the effect of internal suction to enable air to be drawn in.

2. The device according to claim 1, wherein said washer (1) is provided with at least one radial slot (13) extending from the free edge to facilitate deforming said free edge.

3. The device according to claim 1, wherein, when the pump (P) is in the closed position, the inside edge (10) of said washer (1) is deflected inwards under stress while having a portion of an outside face (11) thereof in contact with said shoulder (20).

4. The device according to claim 1, wherein an inside face of said washer (1) is provided with a peripheral keying groove serving to receive a rib (N) provided on a top periphery of the reservoir (R).

* * * * *